US009964064B1

(12) United States Patent
Cribbins et al.

(10) Patent No.: US 9,964,064 B1
(45) Date of Patent: May 8, 2018

(54) METHOD OF IMPROVING ACTIVE FUEL MANAGEMENT REACTIVATION TORQUE RESPONSIVENESS

(71) Applicant: GM GLOBAL TECHNOLOGY OPERATIONS LLC, Detroit, MI (US)

(72) Inventors: Leon O Cribbins, Dexter, MI (US); Nigel K Hyatt, West Bloomfield, MI (US); Carl B Bowman, Wixom, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 13 days.

(21) Appl. No.: 15/343,540

(22) Filed: Nov. 4, 2016

(51) Int. Cl.

| | |
|---|---|
| ***F02D 41/30*** | (2006.01) |
| ***F02D 41/10*** | (2006.01) |
| ***F02D 41/02*** | (2006.01) |
| ***F02D 41/00*** | (2006.01) |

(52) U.S. Cl.
CPC ..... *F02D 41/3005* (2013.01); *F02D 41/0087* (2013.01); *F02D 41/0215* (2013.01); *F02D 41/10* (2013.01); *F02D 2200/101* (2013.01); *F02D 2200/501* (2013.01); *F02D 2200/602* (2013.01)

(58) Field of Classification Search
CPC .. F02D 41/3041; F02D 41/3015; F02D 41/00; F02D 41/0087; F02D 41/10; F02D 2200/502; F02D 2200/602
See application file for complete search history.

(56) References Cited

U.S. PATENT DOCUMENTS 7,856,309 B2 * 12/2010 Gillanders ..... F01N 11/002 477/98
9,777,656 B1 * 10/2017 Bowman ..... F02D 41/123

* cited by examiner

*Primary Examiner* — Hieu T Vo

(57) ABSTRACT

A method of improving active fuel management reactivation torque responsiveness. The method includes detecting a driver torque request signal for increased torque output during active fuel management reactivation, modifying a torque request signal ramp rate based on excess air pressure available within an engine manifold during active fuel management, performing torque shaping on the driver torque request signal using the modified torque request signal ramp rate to obtain a shaped driver torque request signal, modifying manifold model torque estimation based on the excess air pressure available within the engine manifold during active fuel management reactivation, and modifying the smoothed driver torque request signal based on the modified manifold model to increase torque output responsiveness proportional to the driver torque request signal when exiting active fuel management.

20 Claims, 6 Drawing Sheets

METHOD OF IMPROVING ACTIVE FUEL MANAGEMENT REACTIVATION TORQUE RESPONSIVENESS

FIELD

The invention relates generally to automobile engine control and more particularly to a method of improving active fuel management reactivation torque responsiveness.

BACKGROUND

The statements in this section merely provide background information related to the present disclosure and may or may not constitute prior art.

A typical internal combustion engine is a combination of systems that individually serve a specific function. The air intake system provides throttled air to the engine. The fuels system stores, transports, and regulates fuel flow into the combustion chambers of the engine. The ignition system provides spark for igniting the air/fuel mixture. The power conversion system converts the chemical energy of combustion into work that is transferred to the tires of the vehicle. Other systems perform functions that improve fuel economy and emissions, cool the engine and provide heat to the vehicle cabin, or run other accessories such as power steering or air conditioning.

The size of the engine is typically tailored to the size and purpose of the vehicle. For example, a small light car built for fuel efficiency may include a small three cylinder or four cylinder engine with 1.5 to 2.0 Liters of displacement. Alternatively, a full-size pick-up truck or van that is purposely built for carrying tools and pulling machinery will require an engine having a larger displacement and more cylinders. A displacement of 4.5 L and above in a V8 or V10 configuration provides the torque and power required to carry and pull heavy loads, such as when the vehicle is operated in tow/haul mode. However, there are occasions of use when such a vehicle will not require all of the torque available in the V8 or V10 engine. It is during such occasions that it becomes desirable from a fuel efficiency standpoint to deactivate or simply not use all of the cylinders that are available. Thus, a method of operating the engine has been developed to improve fuel economy while maintaining the overall capacity of torque available to the vehicle operator.

Active fuel management methods have been developed which include shutting off fuel delivery to a cylinder when the torque demand on the engine is low. However, there are many issues with controlling an engine and powertrain when using active fuel management. Drivability, torque demand, Noise and Vibration must all be maintained or improved while at the same time improving fuel economy.

It is appreciated that when engine cylinders are deactivated with active fuel management methods that current engine controls for reactivation are designed to allow for smooth transitions out of active fuel management to prevent driveline disturbances. The smooth control results in slow vehicle torque responsiveness during pedal tip-ins which may be undesirable to a vehicle operator during particular circumstances when faster responses are wanted.

Thus, while current active fuel management controls achieve their intended purpose, the need for new and improved active fuel management controls which ensure the vehicle operator's expectations and desires relative to vehicle responsiveness are achieved as according to the operator's input.

SUMMARY

One or more exemplary embodiments address the above issue by providing an automobile engine control system, and more particularly to a method of improving active fuel management reactivation torque responsiveness as according to the operator's input.

According to an aspect of an exemplary embodiment, a method of improving active fuel management reactivation torque responsiveness includes detecting a driver torque request signal for increased torque output during active fuel management. Another aspect of the exemplary embodiment includes modifying a torque request signal ramp rate based on excess air pressure available within an engine manifold during active fuel management. Still another aspect of the exemplary embodiment includes performing torque shaping on the driver torque request signal using the modified torque request signal ramp rate to obtain a shaped driver torque request signal. And still other aspects of the exemplary embodiment include modifying the manifold model torque estimate based on the excess air pressure available within the engine manifold during active fuel management, and modifying the shaped driver torque request signal based on the modified manifold model torque estimate to increase torque output responsiveness proportional to the driver torque request signal when exiting active fuel management.

Yet another aspect of the exemplary embodiment includes using an accelerator pedal position sensor, a vehicle speed sensor, and an engine speed sensor to provide the driver torque request signal, wherein a driver commanded torque request is determined based on vehicle speed, the accelerator pedal position and a cruise control signal to determine a driver target torque request. And yet another aspect wherein the torque request signal ramp rate is at least based on the driver target torque request, gear, turbine speed, and engine speed.

A further aspect of the exemplary embodiment includes determining if a cylinder reactivation torque smoothing mode is active. Yet a further aspect of the exemplary embodiment includes determining a ramp rate modifier based on a linearly interpolated table lookup when the cylinder reactivation torque smoothing mode is active. And still a further aspect of the exemplary embodiment includes setting the torque request ramp rate modifier equal to a predetermined constant value, e.g., 1 when the cylinder reactivation torque smoothing mode is not active.

And another aspect in accordance with the exemplary embodiment includes determining a final torque request ramp rate based on a product of the torque request signal ramp rate and the torque ramp rate modifier. Another aspect of the exemplary embodiment wherein the ramp rate modifier is equal to a linearly extrapolated table lookup using gear and the difference between the driver target torque request signal and a current estimated engine output torque. And still another aspect of the exemplary embodiment includes determining an unfiltered driver torque request based on a sum of the final torque request ramp rate and a previous driver output torque wherein the unfiltered driver output torque request will not exceed the driver target torque request.

In accordance with another aspect of the exemplary, the method further includes shifting cylinder delay array elements up by one (1) at a subsequent compression stroke and inserting the unfiltered driver output torque request as a first element. And another aspect of the exemplary embodiment includes determining a cylinder delay offset when cylinder reactivation torque smoothing mode is active. The cylinder delay offset is based on transmission gear and a difference between the driver target torque request signal and a current estimated engine output torque. And still another aspect of the exemplary embodiment includes determining a manifold filter factor based on the transmission gear and the difference between the driver target torque request signal and a current estimated engine output torque when the cylinder reactivation torque smoothing mode is active. Yet still another aspect includes determining an unfiltered delayed driver output torque request by using the cylinder delay offset to index in to the cylinder delay array.

Another aspect in accordance with the exemplary embodiment includes setting the cylinder delay offset to a predetermined delay offset constant, e.g., 5, and setting the manifold filter factor to a predetermined filter delay constant, e.g., 0.2 when the cylinder reactivation torque smoothing mode is not active. And another aspect wherein the cylinder delay offset is equal to a predetermined cylinder delay offset, and the manifold filter factor is equal to a predetermined manifold filter factor proportional to the difference between the driver torque request signal and a current estimated engine output torque when the cylinder reactivation torque smoothing mode is active. Yet still another aspect includes determining an unfiltered delayed driver output torque request by using the cylinder delay offset to index in to the cylinder delay array.

A further aspect of the exemplary embodiment includes determining a filtered output torque request using a first order lag filter based on the manifold filter factor and the unfiltered delayed driver output torque request. And another aspect includes converting the filtered output torque request to command signals to control actuator outputs in response to the driver torque request signal. Yet another aspect includes converting the filtered output torque request to throttle and active fuel management signals to control actuator outputs in response to the driver torque request signal.

Further objects, aspects and advantages of the present invention will become apparent by reference to the following description and appended drawings wherein like reference numbers refer to the same component, element or feature.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
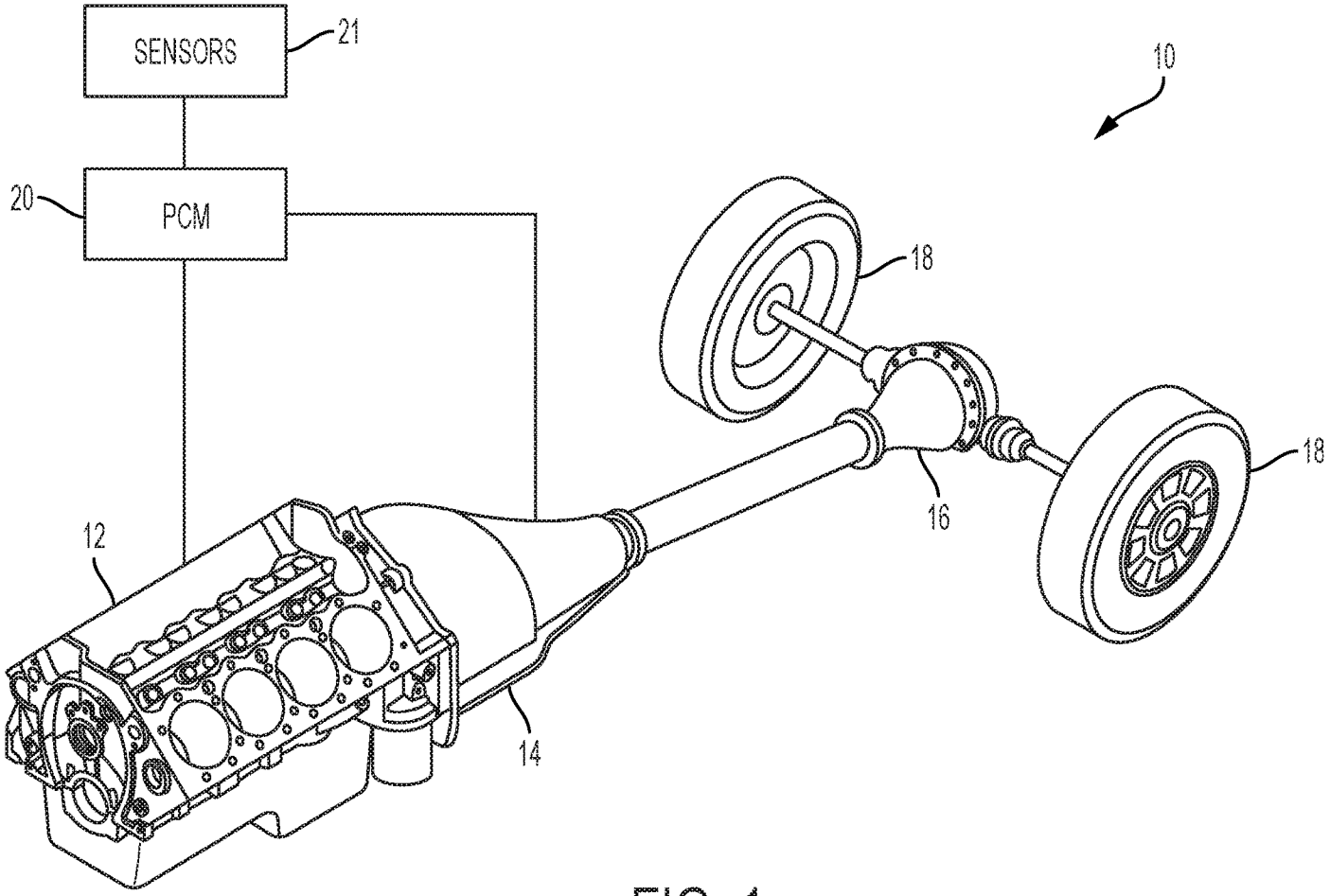
FIG. 1 is a depiction of a powertrain of a vehicle in accordance with an aspect of the exemplary embodiment.

With reference to FIG. 1, an exemplary powertrain is generally indicated by reference number 10. The powertrain 10 includes an engine 12, a transmission 14, a driveshaft and rear differential 16, drive wheels 18, and a powertrain control module 20 (PCM). Sensors 21 are in communication with the PCM 20 and can include, for example, an accelerator position sensor (not shown) that senses the instantaneous position of an accelerator pedal, a brake pedal position sensor that senses the position of a brake pedal (also not shown), etc. The sensors 21 can then provide that information to the PCM 20.

The PCM 20 operates as the "brain" of a vehicle and controls a plurality of actuators on an internal combustion engine to ensure optimal engine performance. The PCM 20 is generally a combined control unit, consisting of an engine control unit (ECU) and a transmission control unit (TCU). The PCM 20 can compute the driver's commanded engine torque based on the vehicle speed and the position of accelerator pedal which sends a signal representative of the driver's torque request to the PCM 20. The PCM 20 can also use the instantaneous position of the accelerator pedal (interpreted from an accelerator pedal position sensor signal) to compute a rate of the accelerator pedal position (or accelerator pedal position rate), and use the engine speed (from a cam sensor) to compute an engine acceleration and/or vehicle speed.

Sensors 21 can also include, for example, engine speed sensors such as a crank position sensor that can detect position and/or speed of a crankshaft and/or a cam position sensor that can detect position and/or speed of a camshaft (not shown), and provide that information to the PCM 20. For example, the crank position sensor can be used to detect position of crankshaft, and the cam position sensor can be used to detect position of camshaft (not shown). In either case, the raw position signal (in terms of frequency (Hz)) can be sent to PCM 20 and conditioned/converted to speed (in terms of rpm). In this regard, the engine speed signals may be considered raw engine speed signals until signal conditioned by the PCM 20 or other signal conditioning circuitry. The sensors 21 can also include a wheel speed sensor (not shown) that can detect true vehicle speed and provide it to the PCM 20.

Sensors 21 can also include proximity sensors for monitoring movement of the intake and exhaust valves of an engine cylinder, an accelerometer for monitoring engine knock or misfires, a torque sensor for measuring torque out of the engine, and a manifold air pressure sensor for monitoring the air intake pressure of the engine. Other pressure sensors can be included to monitor the real time pressure of each cylinder in accordance with the exemplary embodiment. Sensors 21 can include special circuits for monitoring the electrical characteristics of each cylinder before and after combustion cycle in accordance with aspects of the exemplary embodiment.

The engine 12 is an internal combustion engine that supplies a driving torque to the transmission 14. Traditionally, an internal combustion engine is identified by the number of cylinders it includes and in what configuration the cylinders are arranged. The engine 12 shown is a V8 configured engine 12 as the engine 12 includes eight cylinders arranged in a "V" configuration. The transmission 14, capable of several forward gear ratios, in turn delivers torque to the driveshaft and rear differential 16 and drive wheels 18.

Figure 2:
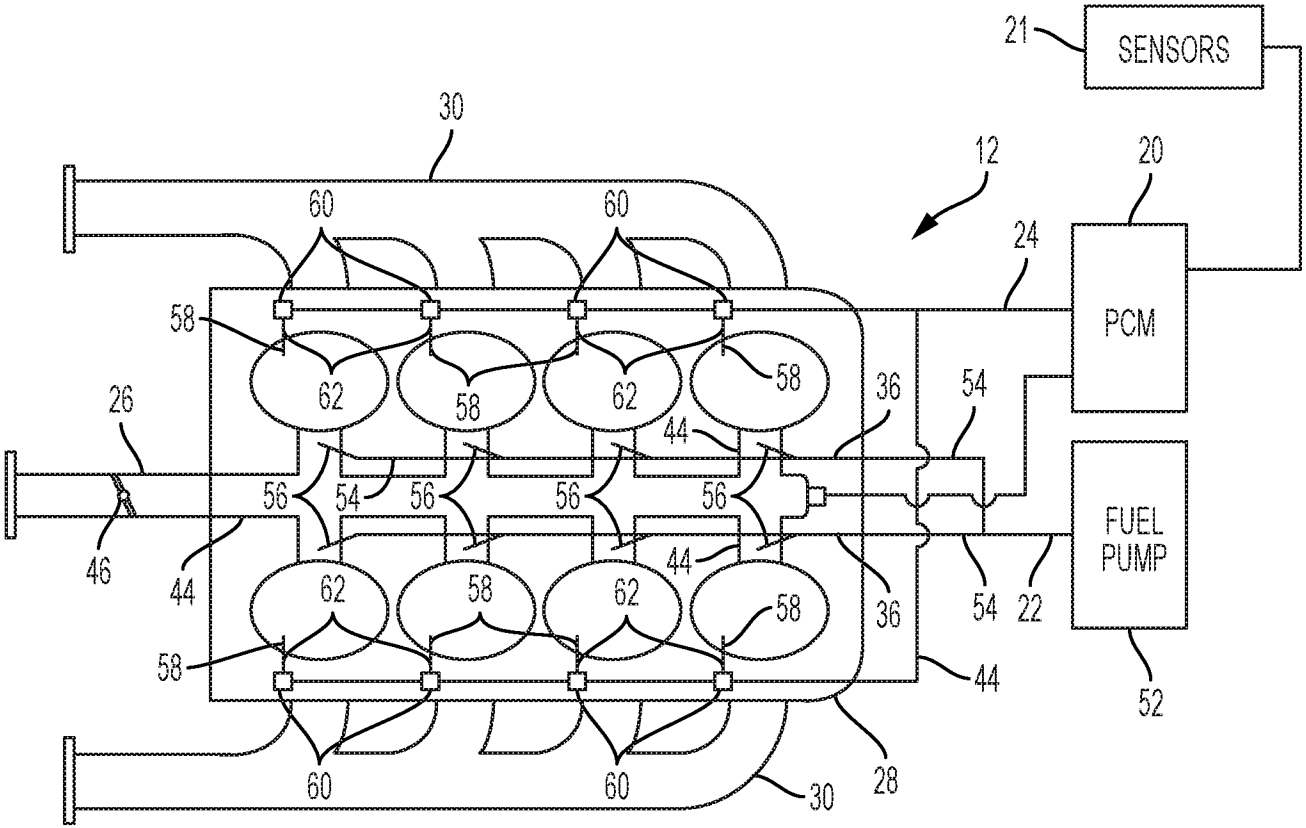
FIG. 2 is a top view schematic of an internal combustion engine, in accordance with an aspect of the exemplary embodiment.
Figure 3:
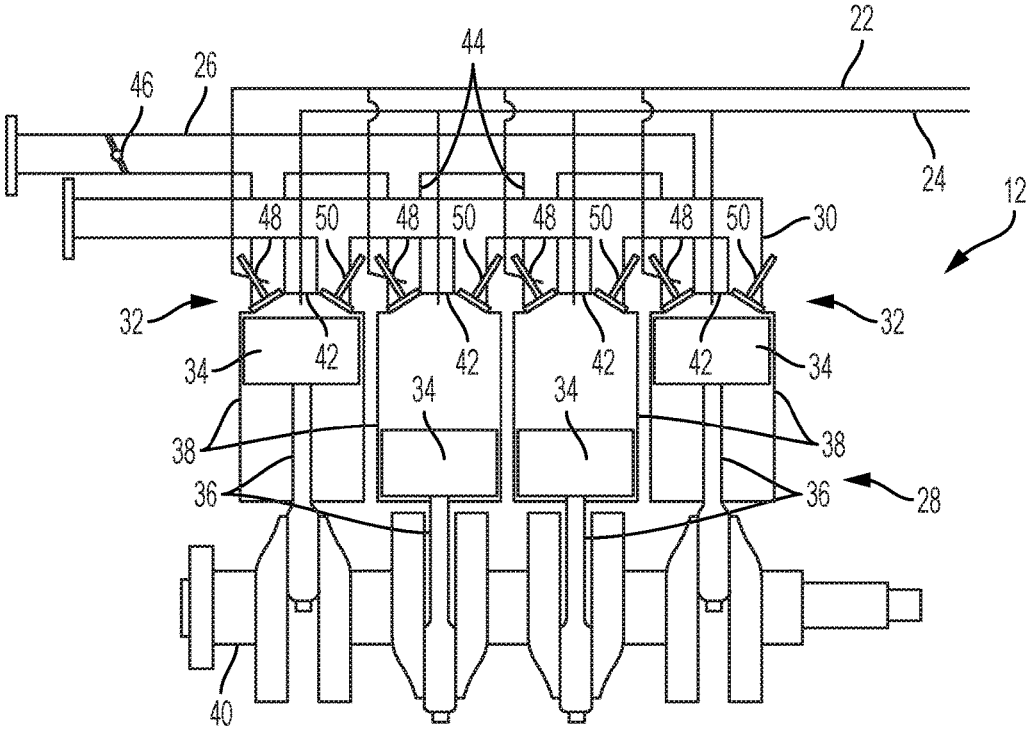
FIG. 3 is a side view schematic of an internal combustion engine, in accordance with an aspect of the exemplary embodiment.

Turning now to FIGS. 2 and 3, the engine 12 is illustrated and described in greater detail. The engine 12 as a system is a combination of multiple sub-systems operating in a coordinated manner managed by the powertrain control module 20 to convert combustion into mechanical work. For example, the engine 12 may include a fuel delivery system 22, an ignition system 24, an air intake system 26, a power conversion system 28, an exhaust system 30, and a valve train system 32, among other subsystems. More particularly, the power conversion system 28 includes a plurality of pistons 34, connecting rods 36, cylinders 38, and a crankshaft 40. Each piston 34 is disposed in one of the cylinders 38 with the piston 34 pinned to an end of a connecting rod 36 with the other end of the connecting rod 36 pinned to an offset journal of the crankshaft 40. The top side of the piston 34 and the cylinder 38 form a combustion chamber 42. The crankshaft 40 is connected on one end to an output member (not shown) for transferring torque to the transmission 14.

The air intake system 26 includes a plurality of air ducts 44 and a throttle valve 46. The throttle valve 46 controls the amount of airflow passing into the air intake system 26 while the air ducts 44 direct incoming air to be used in the combustion process into the combustion chamber 42.

The valve train system 32 includes an intake valve 48 and an exhaust valve 50 in each cylinder 38 and a mechanism (not shown) for actuating the intake valve 48 and exhaust valve 50. The intake valve 48 opens to allow communication between the air ducts 44 of the air intake system 26 and the combustion chamber 42. In the present example, there is only one intake valve 48 and one exhaust valve 50 in each combustion chamber 42. However, a valve train system 32 having more than one intake valve 48 or exhaust valve 50 in each cylinder 38 may be considered without departing from the scope of the present invention.

In accordance with aspects of the exemplary embodiment, a full authority active fuel management system (not shown) is operative to control the activation and deactivation of the intake and exhaust valves associated with each engine cylinder. In deactivation, the valves remain closed during engine cylinder intake and exhaust strokes which reduces pumping losses and the capacity for engine braking. For example, for a V8 engine, the full authority active fuel management system can selectively disable one, two, four or any number up to all eight of the engine cylinders 38 based on the vehicle speed and the brake pedal position to meet a desired level of vehicle deceleration during deceleration fuel cutoff mode (DFCO) as according to the exemplary embodiment. Conversely, the full authority active fuel management system can selectively reactivate cylinders 38 based on vehicle speed and a driver's commanded torque request determined by an accelerator pedal position sensor.

The fuel delivery system 22 includes a pressurized fuel source or fuel pump 52, fuel lines 54, and fuel injectors 56. The fuel pump 52 is disposed in the fuel tank (not shown) located elsewhere in the vehicle. The fuel pump 52 pressurizes the fuel lines 54 which deliver pressurized fuel to the fuel injectors 56. The fuel injectors 56 are disposed in the air ducts 44 of the air intake system 26 proximate the intake valve 48. The fuel injectors 56 may also be located in the combustion chamber 42 wherein the fuel is injected directly into the combustion chamber 42.

The ignition system 24 includes spark plugs 58, ignition coils 60, and ignition wires 62. A single spark plug 58 is disposed in each of the combustion chambers 42. An ignition coil 60 is disposed electrically between the powertrain control module 20 and each of the spark plugs 58. The powertrain control module 20 sends a low voltage electric signal to the ignition coils 60 where the signal is stepped to a high-voltage signal required to create a spark and then sent to the spark plugs 58 through the ignition wires 62.

The exhaust system 30 collects exhaust gases from the combustion process in the combustion chamber 42 and directs the gases through a series of after treatment mechanisms such as catalytic converters and mufflers (not shown). Some of the exhaust gases can be diverted back to the intake system for improved combustion and fuel economy.

The powertrain control module 20 is electronically connected to at least the engine 12 and transmission 14 and is preferably an electronic control device having a preprogrammed digital computer or processor, control logic, memory used to store data, and at least one I/O peripheral. The control logic includes a plurality of logic routines or sequence for monitoring, manipulating, and generating data. The powertrain control module 20 controls the operation of each of the engine 12 and transmission 14. The control logic may be implemented in hardware, software, or a combination of hardware and software. For example, control logic may be in the form of program code that is stored on the electronic memory storage and executable by the processor. The powertrain control module 20 receives the output signals of several sensors 21 throughout the transmission 14 and engine 12, performs the control logic and sends command signals to the engine 12 and transmission 14. The engine 12 and transmission 14 receive command signals from the powertrain control module 20 and converts the command signals to control actions operable in the engine 12 and transmission 14. Some of the control actions include but are not limited to increasing engine 12 speed, changing air/fuel ratio, changing transmission 14 gear ratios, etc., among many other control actions.

For example, a control logic implemented in software program code that is executable by the processor of the powertrain control module 20 includes control logic for implementing a method of operating the engine 12 in an active fuel management or cylinder deactivation mode or method. The cylinder deactivation mode is initiated to improve fuel consumption by cutting off fuel delivery to or deactivating selected cylinders while torque demand on the engine is less than the maximum torque available from the engine. A portion of the cylinder deactivation mode is controlling the operation of the engine as the engine is operating under cylinder deactivation mode and the vehicle operator is requesting additional torque. Such a portion of engine control is a cylinder reactivation torque smoothing control method (not shown). An important goal of the cylinder reactivation torque smoothing control method is to provide a smooth, measured increase in torque from the engine 12 as the operator is requesting an increase in torque delivery to the wheels 18. In accordance with the exemplary embodiment, it is also important to ensure the vehicle operator's expectations and desires relative to vehicle responsiveness are achieved as according to the operator's input when exiting active fuel management or cylinder deactivation mode.

Figure 4A:
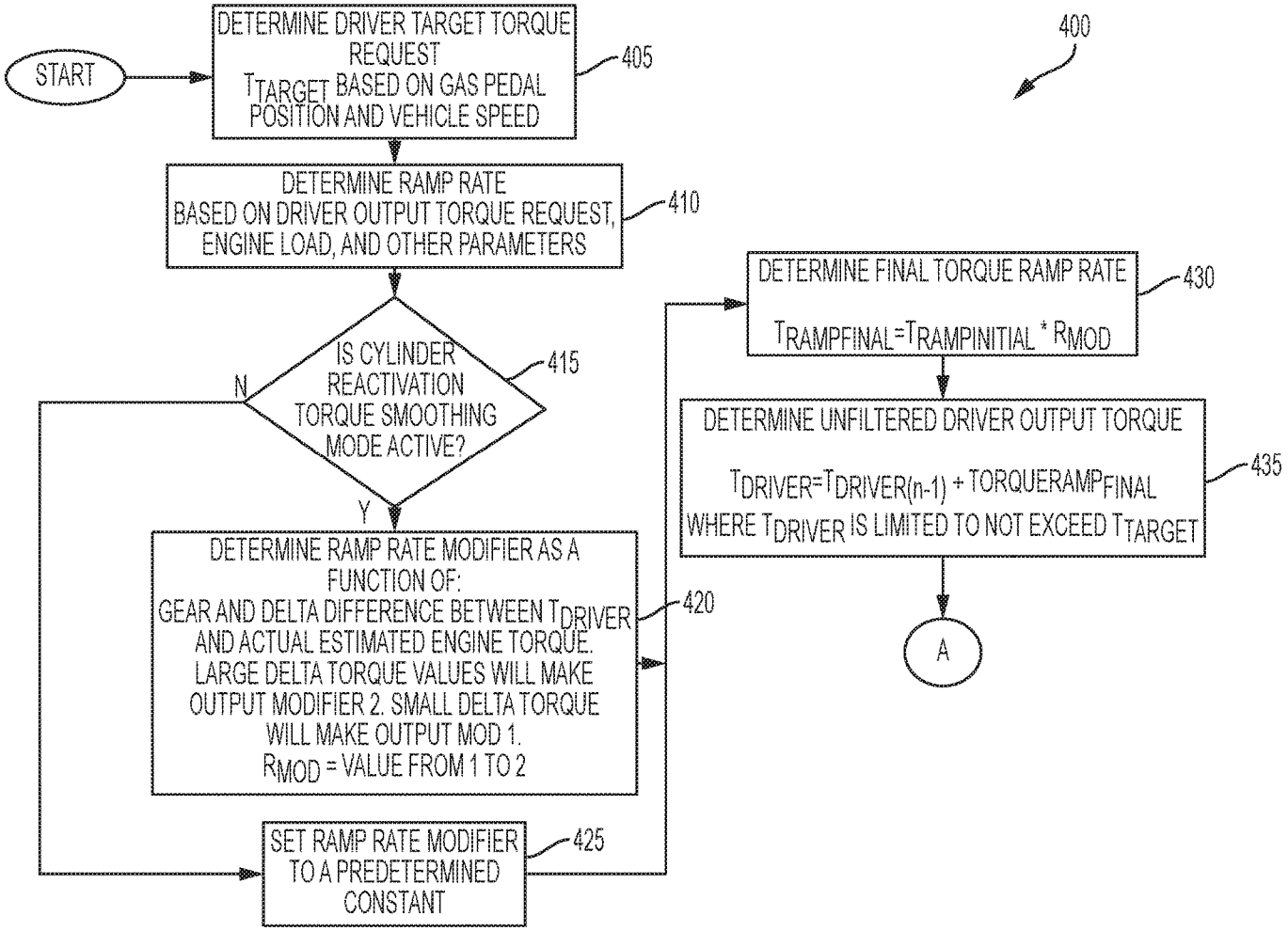
FIG. 4A is a schematic depicting a method of improving active fuel management reactivation torque responsiveness, in accordance with an aspects of the exemplary embodiment.

Referring now to FIG. 4*a*, a schematic depicting a method 400 of improving active fuel management reactivation torque responsiveness, in accordance with aspects of the exemplary embodiment is provided. At block 405, the method 400 begins with detecting a driver target torque request. This may be accomplished using an accelerator pedal position sensor or a throttle position sensor for detecting a "tipping in" condition which is indicative of the driver's foot being pressed on the accelerator pedal, determining the vehicle speed which can be computed by the PCM 20 using an input from a wheel speed sensor, and arbitrating the driver commanded torque request with other requestors such as cruise control to determine a driver target torque request ($T_{Target}$). For example, if the driver commanded torque request is greater than a cruise control command then the driver target torque request ($T_{Target}$) will be equal to the driver commanded torque request. Likewise, if the cruise control command is greater than the driver commanded torque input then the driver target torque request ($T_{Target}$) will be equal to the cruise control command.

At block 410, the method continues with determining a torque request signal ramp rate ($T_{RampInitial}$) that is at least based on the driver target torque request, gear, turbine speed, and engine speed. These parameters can be determined by the PCM by receiving inputs signals from various sensors 21 at the engine 12 and transmission 14.

At block 415, the method continues with determining if cylinder reactivation torque smoothing mode is active. This mode becomes active for a brief amount of time when the engine active fuel management transitions from cylinder deactivation mode to cylinder reactivation mode and attempts to provide smooth torque during this transition. If cylinder reactivation smoothing mode is active then the method moves to block 420 for determining a torque request ramp rate modifier ($R_{mod}$) using a linearly interpolated lookup table based on transmission gear and a difference between the driver target torque request signal and a current estimated engine output torque If the difference between the driver target torque request signal and the current estimated engine output torque is large then the torque request ramp rate modifier will be proportionally equal to the output of a linearly extrapolated lookup table value in accordance with aspects of the exemplary embodiment. For example, if the difference is large (>30% max engine torque) then the ramp rate modifier would be equal to two (2) and if the difference is small (<10% max engine torque) then the ramp rate modifier will be equal to one (1), and if the difference is between these points then the ramp rate modifier would be some value between one (1) and two (2).

At block 425, the method continues setting the torque request ramp rate modifier ($R_{mod}$) equal to a predetermined constant value when the cylinder reactivation torque smoothing mode is not active. For example, if the reactivation torque smoothing mode is not active them the ramp rate modifier will be equal to one (1).

At block 430, the method continues with determining a final torque request ramp rate ($T_{RampFinal}$) based on a product of the torque request signal ramp rate and the torque ramp rate modifier. The relevant equation is:

$$T_{RampFinal}=T_{RampInitial}*R_{mod}$$

A block 435, the method continues with determining an unfiltered driver output torque request ($T_{Driver}$) based on a sum of the final torque request ramp rate ($T_{RampFinal}$) and the previous software control loop value of unfiltered driver output torque request ($T_{Driver(n-1)}$) wherein the unfiltered driver output torque request will not exceed the driver target torque request. The unfiltered driver output torque request is calculated using:

$$T_{Driver}=\min[T_{Target}(T_{Driver(n-1)}+T_{RampFinal})]$$

Figure 4B:
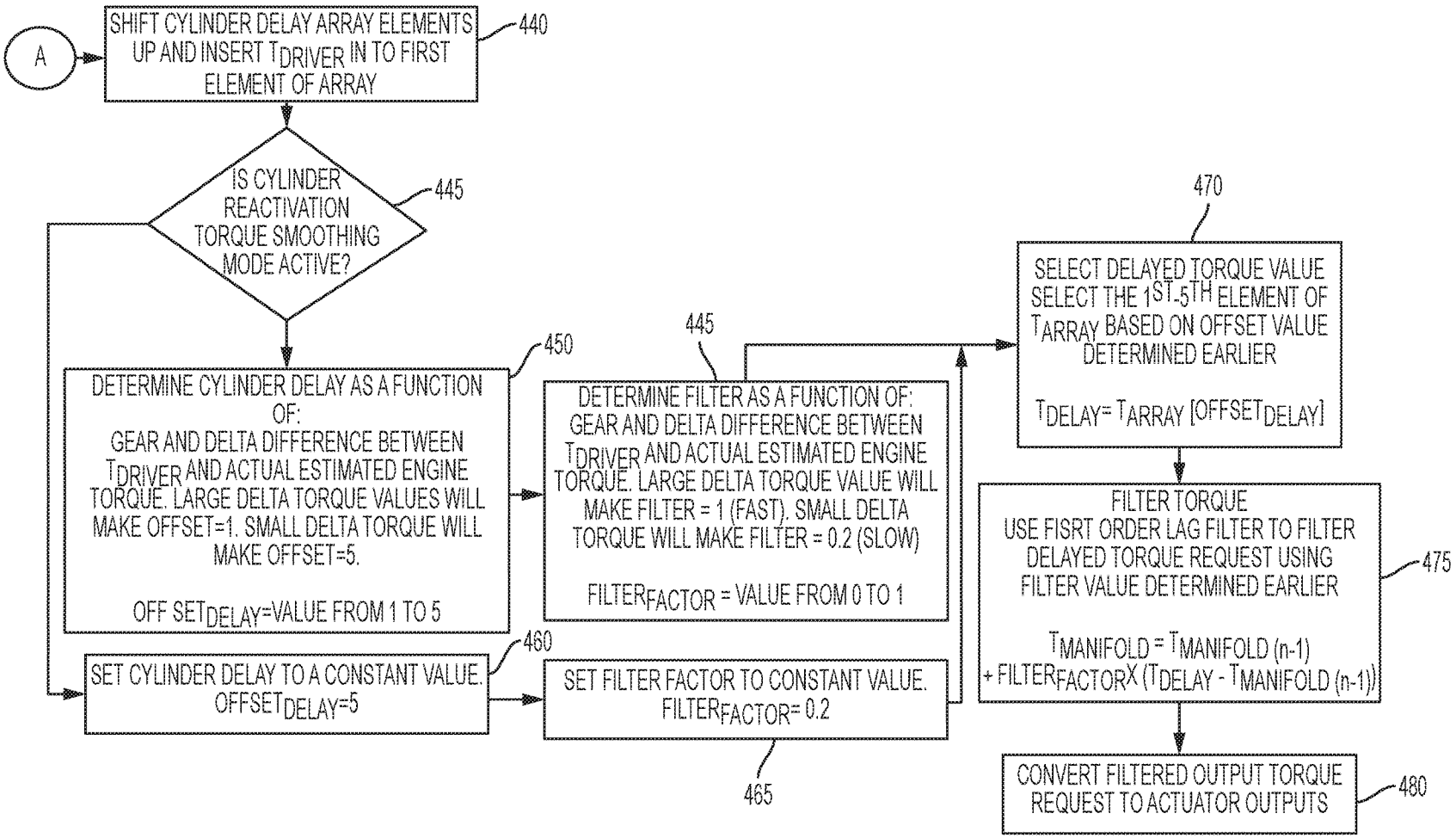
FIG. 4B is a continuation of schematic depicting a method of improving active fuel management reactivation torque responsiveness, in accordance with an aspects of the exemplary embodiment.
Figure 5:
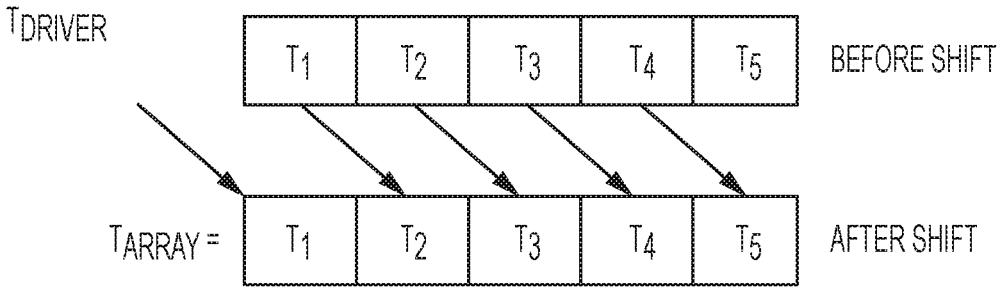
FIG. 5 is an illustration of how the unfiltered driver output torque request would be inserted into $T_{array}$.

Referring now to FIG. 4*b*, the method continues at block 440 with shifting cylinder delay array elements up by one (1) at a subsequent compression stroke and inserting the unfiltered driver output torque request as a first element. For example as shown in FIG. 5, the unfiltered driver output torque request would be inserted into $T_{array}$ accordingly.

At block 445, the method continues with determining if a cylinder reactivation torque smoothing mode is active. And, at block 450, with determining a cylinder delay offset ($Offset_{delay}$) based on transmission gear and a difference between the driver target torque request signal and a current estimated engine output torque when the cylinder reactivation torque smoothing mode is active. The cylinder delay offset is based on a linearly extrapolated lookup table using as it's input the difference between the driver target torque request signal and a current estimated engine output torque and transmission gear.

For example, if the difference is large (ie, >30% max engine torque) then the cylinder delay offset will be equal to one (1), and if the difference is small (ie, <10% max engine torque) then the cylinder delay offset will be equal to five (5), and if the difference is between these torque limits of 10% and 30% then the cylinder delay offset will be some value between one (1) and five (5) in accordance with aspects of the exemplary embodiment. It is appreciated that the cylinder delay offset may vary in direct proportion to the extent of the difference between the driver target torque request signal and a current estimated engine output torque.

At block 455, the method continues with determining a manifold filter factor ($Filter_{Factor}$) using a linearly interpolated lookup table based on transmission gear and a difference between the driver target torque request signal and a current estimated engine output torque when the cylinder reactivation torque smoothing mode is active. It is appreciated that the manifold filter factor may vary in direct proportion to the extent of the difference between the driver target torque request signal and a current estimated engine output torque. For example, if the difference between the driver target torque request signal and a current estimated engine output torque is greater than 30% max engine torque then the predetermined manifold filter factor will be one (1) for a shorter delay, and if the difference is less than 10% max engine torque then the manifold filter factor will be two tenths (0.2) for a longer delay, and if the difference is between these torque values then the manifold filter factor will be between two tenths (0.2) and one (1).

At block 460, the method continues with setting the cylinder delay offset ($Offset_{delay}$) to a predetermined delay offset constant, and at block 465, setting the manifold filter factor ($Filter_{Factor}$) to a predetermined filter delay constant when the cylinder reactivation torque smoothing mode is not active.

At block 470, the method continues with selecting an unfiltered delayed driver output torque request based on the cylinder delay offset. The $1^{st}$-$5^{th}$ element of $T_{array}$ is selected based on the cylinder delay offset ($Offset_{delay}$) as according to the equation:

$$T_{delay}=T_{array}[Offset_{delay}]$$

At block 475, the method continues with determining a filtered output torque request ($T_{filtered}$) using a first order lag filter based on the manifold filter factor ($Filter_{Factor}$), the unfiltered delayed driver output torque request ($T_{delay}$), and the previous software control loop value of filtered output torque request signal ($T_{filtered(n-1)}$). In accordance with the exemplary embodiment, the equation to calculate the filtered output torque is:

$$T_{filtered}=T_{filtered(n-1)}+\text{Filter}_{Factor}*(T_{delay}-T_{filtered(n-1)})$$

At block 480, the method continues with converting the filtered output torque request ($T_{filtered}$) to ignition spark, fuel injector, throttle and active fuel management request signals to control actuator outputs in response to the driver output torque request.

The description of the method is merely exemplary in nature and variations that do not depart from the gist of the embodiment are intended to be within the scope of the embodiment. Such variations are not to be regarded as a departure from the spirit and scope of the exemplary embodiment.

What is claimed is:

1. A method of improving active fuel management reactivation torque responsiveness comprising:

detecting a driver torque request signal for increased torque output during active fuel management;

modifying a torque request signal ramp rate based on excess air pressure available within an engine manifold during active fuel management;

performing torque shaping on the driver torque request signal using the modified torque request signal ramp rate to obtain a shaped driver torque request signal;

modifying manifold model torque estimate based on the excess air pressure available within the engine manifold during active fuel management; and modifying the shaped driver torque request signal based on the modified manifold model to increase torque output responsiveness proportional to the driver torque request signal when exiting active fuel management.

2. The method of claim 1 wherein detecting further comprises using an accelerator pedal position sensor, vehicle speed sensor, and engine speed sensor to provide the driver torque request signal.

3. The method of claim 2 wherein a driver commanded torque request is at least determined based on vehicle speed, the accelerator pedal position, and a cruise control signal to determine a driver target torque request.

4. The method of claim 3 wherein the torque request signal ramp rate is at least based on the driver target torque request, gear, turbine speed, and engine speed.

5. The method of claim 3 wherein performing further comprises determining if a cylinder reactivation torque smoothing mode is active.

6. The method of claim 5 further comprises determining a ramp rate modifier based a linearly interpolated table lookup when the cylinder reactivation torque smoothing mode is active.

7. The method of claim 6 further comprises setting the torque request ramp rate modifier equal to a predetermined constant value when the cylinder reactivation torque smoothing mode is not active.

8. The method of claim 7 further comprises determining a final torque request ramp rate based on a product of the torque request signal ramp rate and the torque ramp rate modifier.

9. The method of claim 6 wherein the ramp rate modifier is equal to a linearly extrapolated table lookup value using gear and the difference between the driver target torque request signal and a current estimated engine output torque.

10. The method of claim 8 further comprises determining an unfiltered driver torque request based on a sum of the final torque request ramp rate and a previous driver output torque wherein the unfiltered driver output torque request will not exceed the driver target torque request.

11. The method of claim 10 further comprises shifting cylinder delay array elements up by one (1) at a subsequent compression stroke and inserting the unfiltered driver output torque request as a first element.

12. The method of claim 11 further comprises determining a cylinder delay offset based on transmission gear and a difference between the driver target torque request signal and a current estimated engine output torque when the cylinder reactivation torque smoothing mode is active.

13. The method of claim 12 further comprises determining a manifold filter factor based on the transmission gear and the difference between the driver torque request signal and a current estimated engine output torque when the cylinder reactivation torque smoothing mode is active.

14. The method of claim 13 further comprises setting the cylinder delay offset to a predetermined delay offset constant, and setting the manifold filter factor to a predetermined filter delay constant when the cylinder reactivation torque smoothing mode is not active.

15. The method of claim 14 wherein the cylinder delay offset is equal to a predetermined cylinder delay offset, and the manifold filter factor is equal to a predetermined manifold filter factor proportional to the difference between the driver torque request signal and a current estimated engine output torque when the cylinder reactivation torque smoothing mode is active.

16. The method of claim 15 further comprises determining an unfiltered delayed driver output torque request by using the cylinder delay offset to index in to the cylinder delay array.

17. The method of claim 16 further comprises determining a filtered output torque request using a first order lag filter based on the manifold filter factor and the unfiltered delayed driver output torque request.

18. The method of claim 17 further comprises converting the filtered output torque request to spark and fuel actuator request signals to control actuator outputs in response to the driver torque request signal.

19. The method of claim 18 further comprises converting the filtered output torque request to throttle and active fuel management signals to control actuator outputs in response to the driver torque request signal.

20. A method of improving active fuel management reactivation torque responsiveness comprising:

detecting a driver torque request signal for increased torque output during active fuel management;

modifying a torque request signal ramp rate based on excess air pressure available within an engine manifold during active fuel management;

determining if a cylinder reactivation torque smoothing mode is active;

performing torque shaping on the driver torque request signal using the modified torque request signal ramp rate to obtain a shaped driver torque request signal;

modifying manifold model torque estimate based on the excess air pressure available within the engine manifold during active fuel management; and modifying the shaped driver torque request signal based on the modified manifold model to increase torque output responsiveness proportional to the driver torque request signal when exiting active fuel management.

* * * * *